US010080405B2

(12) United States Patent
Cheng

(10) Patent No.: US 10,080,405 B2
(45) Date of Patent: Sep. 25, 2018

(54) DOUBLE-LAYERED WATERTIGHT ZIPPER

(71) Applicant: UNITECH ZIPPER & MACHINERY CO., LTD., New Taipei (TW)

(72) Inventor: Jung-Yuan Cheng, New Taipei (TW)

(73) Assignee: UNITECH ZIPPER & MACHINERY CO., LTD., New Taipei (TW)

( * ) Notice: Subject to any disclaimer, the term of this patent is extended or adjusted under 35 U.S.C. 154(b) by 0 days.

(21) Appl. No.: 15/466,982

(22) Filed: Mar. 23, 2017

(65) Prior Publication Data

US 2018/0020784 A1 Jan. 25, 2018

(30) Foreign Application Priority Data

Jul. 20, 2016 (TW) ..... 105122944 A

(51) Int. Cl.

| | |
|---|---|
| ***A44B 19/32*** | (2006.01) |
| ***A44B 19/08*** | (2006.01) |
| ***A44B 19/24*** | (2006.01) |
| ***A44B 19/42*** | (2006.01) |
| ***A44B 19/06*** | (2006.01) |

(52) U.S. Cl.

CPC ..... *A44B 19/32* (2013.01); *A44B 19/06* (2013.01); *A44B 19/08* (2013.01); *A44B 19/24* (2013.01); *A44B 19/42* (2013.01)

(58) Field of Classification Search

CPC ..... A44B 19/08; A44B 19/24; A44B 19/32; A44B 19/42

See application file for complete search history.

(56) References Cited

U.S. PATENT DOCUMENTS

| | | | | |
|---|---|---|---|---|
| 2,910,754 A | | 11/1959 | Morin | |
| 3,668,745 A | * | 6/1972 | Krupp | A44B 19/32 24/389 |
| 4,502,190 A | * | 3/1985 | Inamura | A44B 19/32 24/389 |
| 4,601,085 A | * | 7/1986 | Yoshida | A44B 19/32 24/384 |
| 4,765,038 A | * | 8/1988 | Kasai | A44B 19/06 24/389 |

(Continued)

FOREIGN PATENT DOCUMENTS

TW I251477 B 3/2006

*Primary Examiner* — David M Upchurch

(74) *Attorney, Agent, or Firm* — Alan D. Kamrath; Kamrath IP Lawfirm, P.A.

(57) ABSTRACT

A double-layered watertight zipper improves the watertight effect of the conventional zipper. The watertight zipper includes first and second stringer tapes. Each stringer tape includes a tape, a first leakproof layer, a plurality of scoops and a second leakproof layer. The first leakproof layer and the tape construct a waterproof tape. The first leakproof layer includes an inner face forming a first abutting face. The scoops are arranged on the waterproof tape. The second leakproof layer is arranged on the scoops and connected to the first leakproof layer. The second leakproof layer includes an inner face forming a second abutting face. When the scoops of the first and second stringer tapes are engaged with each other, the first abutting faces of the first and second stringer tapes abut with each other, and the second abutting faces of the first and second stringer tapes abut with each other.

17 Claims, 14 Drawing Sheets

(56) References Cited

U.S. PATENT DOCUMENTS

| | | | | |
|---|---|---|---|---|
| 4,817,252 | A * | 4/1989 | Kusayama | A44B 19/32 24/381 |
| 7,337,506 | B2 | 3/2008 | Kusayama et al. | |
| 7,416,397 | B2 | 8/2008 | Kusayama et al. | |
| 7,870,649 | B2 * | 1/2011 | Mikuma | A44B 19/04 24/403 |
| 2005/0235466 | A1 * | 10/2005 | Segawa | A44B 19/34 24/396 |
| 2006/0207069 | A1 * | 9/2006 | Cheng | A44B 19/32 24/389 |
| 2008/0040837 | A1 * | 2/2008 | King | A41D 13/012 2/227 |
| 2009/0165265 | A1 * | 7/2009 | Chen | A44B 19/32 24/389 |
| 2009/0320250 | A1 * | 12/2009 | Yamamoto | A44B 19/32 24/389 |
| 2012/0137476 | A1 * | 6/2012 | La Rocca | A44B 19/06 24/405 |
| 2012/0311828 | A1 * | 12/2012 | Nir | A44B 19/04 24/389 |
| 2014/0366337 | A1 * | 12/2014 | Chou | A44B 19/24 24/389 |
| 2015/0143672 | A1 * | 5/2015 | Konaka | A44B 19/32 24/381 |

* cited by examiner

DOUBLE-LAYERED WATERTIGHT ZIPPER

CROSS REFERENCE TO RELATED APPLICATIONS

The application claims the benefit of Taiwan application serial No. 105122944, filed on Jul. 20, 2016, and the subject matter of which is incorporated herein by reference.

BACKGROUND OF THE INVENTION

1. Field of the Invention

The present invention generally relates to a zipper and, more particularly, to a double-layered watertight zipper that can effectively prevent penetration of liquid.

2. Description of the Related Art

FIG. 1 shows a conventional waterproof tape 8 having an elastic waterproof material 81. The waterproof material 81 includes a plurality of through-holes 8 which is arranged on the waterproof material 81 in even intervals. A scoop 83 is integrally formed through the through-hole 82. Referring to FIG. 2, a pair of the waterproof tapes 8 is provided. When the scoops 83 of the two waterproof tapes 8 are engaged with each other, the opposing end faces of the waterproof tapes 8 can abut with each other, preventing the liquid from passing therethrough. An embodiment of such a conventional waterproof tape 8 can be seen in U.S. Pat. No. 2,910,754.

FIG. 3 shows another conventional waterproof tape 9. The waterproof tape 9 includes a stringer tape 91 enveloped by a leakproof layer 92. A plurality of scoops 93 is coupled to the leakproof layer 92 by fusion bonding. Based on this, when the scoops 93 of two waterproof tapes 9 (left and right ones) are engaged with each other, the opposing end faces of the left and right leakproof layers 92 can abut with each other, preventing the liquid from passing between the left and right scoops 93. Also, a double-side leakproof effect is attained. An embodiment of such a conventional waterproof tape 9 can be seen in Taiwan Patent No. 1251477.

The waterproof tapes 8 (or 9) can be used to form a watertight zipper having a certain leakproof effect. However, the watertight zipper has only a single layer of the leakproof layer in which the left and right waterproof tapes of the watertight zipper are pressed against each other to provide the leakproof effect. Therefore, when the watertight zipper undergoes an impact from a high pressure fluid or is placed into a liquid by a large depth where the environmental pressure is high, some parts of the left and right waterproof tapes of the watertight zipper may be forced open by the pressure. As a result, leakage of liquid results. As a disadvantage, the watertight zippers constructed by the waterproof tapes 8 and 9 are not able to provide a sufficient leakproof effect.

In light of the deficiency, it is necessary to improve the conventional watertight zippers.

SUMMARY OF THE INVENTION

It is therefore the objective of this invention to provide a double-layered watertight zipper. With the double-layered watertight zipper, although a small amount of high pressure liquid may possibly penetrate the leakproof layer of the tape, the high pressure liquid will be stopped by the leakproof layer of the scoops due to the reduced pressure.

In an embodiment of the invention, a double-layered watertight zipper including first and second stringer tapes is disclosed. The first and second stringer tapes can be engaged with each other. Each of the first and second stringer tapes includes a tape, a first leakproof layer, a plurality of scoops and a second leakproof layer. The first leakproof layer is arranged on an outer face of the stringer tape. The first leakproof layer and the tape construct a waterproof tape. The first leakproof layer includes an inner face forming a first abutting face. The plurality of scoops is arranged on the waterproof tape in intervals side by side adjacent to an inner lateral side of the waterproof tape. The second leakproof layer is arranged on the plurality of scoops and is connected to the first leakproof layer. The second leakproof layer includes an inner face forming a second abutting face. When the plurality of scoops of the first stringer tape is engaged with the plurality of scoops of the second stringer tape, the first abutting face of the first stringer tape is in abutment with the first abutting face of the second stringer tape, and the second abutting face of the first stringer tape is in abutment with the second abutting face of the second stringer tape.

As such, although a small amount of high pressure liquid may possibly pass between the first leakproof layers of the double-layered watertight zipper of the invention, the high pressure liquid will be stopped by the second leakproof layers due to the reduced pressure. Thus, the watertight zipper has an excellent watertight effect.

In a form shown, each of the plurality of scoops includes a first scoop portion and a second scoop portion. The first scoop portion includes a head portion, a waist portion and a tail portion connected in sequence. The head portion includes a free end extending beyond the first abutting face of the first leakproof layer. The waist portion forms a groove. An inner stopper wall is formed at a side of the waist portion adjacent to the head portion, and an outer stopper wall is formed at another side of the waist portion adjacent to the tail portion. The outer stopper wall is higher than the inner stopper wall. The second leakproof layer includes an outer end face opposite to the second abutting face. The waist portions of the plurality of scoops form a plurality of spaces therebetween. The plurality of spaces and the grooves of the plurality of scoops are filled with the second leakproof layer. The outer end face of the second leakproof layer is connected to the outer stopper walls of the first scoop portions. This structure is simple and can be easily formed.

In the form shown, the second abutting face of the second leakproof layer flushes with the first abutting face of the first leakproof layer in a thickness direction of the tape. In this arrangement, any two stringer tapes can make a watertight zipper without having to distinguish which stringer tape must serve as the left one and which stringer tape must serve as the right one. Advantageously, convenient manufacture of the watertight zipper is attained.

In the form shown, each of two ends of the waist portion forms a concave portion. This arrangement can increase the contact area between the second leakproof layer and the first leakproof layer, enhancing the bonding strength and prolonging the service life.

In the form shown, the head portion of the first scoop portion includes a positioning hole. This arrangement can enhance the bonding strength between the second leakproof layer and the scoops.

In the form shown, the positioning hole extends through the head portion, and the first leakproof layer at a bottom end of the positioning hole is exposed from the positioning hole. In this arrangement, it is even more difficult to separate the second leakproof layer and the first leakproof layer from each other, improving the bonding strength therebetween.

In the form shown, the second leakproof layer is formed by injection molding. This arrangement can ensure evenness of the second abutting face of the second leakproof layer, improving the watertight effect.

In the form shown, the first and second leakproof layers are made of a same material or the second leakproof layer has a higher melting point than the first leakproof layer. This arrangement permits the second leakproof layer and the first leakproof layer to fuse together, enhancing the bonding strength between the first and second leakproof layers.

In the form shown, the head portion includes a root end connecting to the waist portion, as well as the free end opposite to the root end. The head portions of the first scoop portions of two adjacent ones of the plurality of scoops are spaced from each other in an increasing distance from the root ends to the free ends thereof. This arrangement permits fast removal of the mold, thus improving the convenience in forming the second leakproof layer and the yield rate of the second leakproof layer.

In the form shown, the first scoop portion includes a base, a tongue and a limiting wall. The base is connected to the first leakproof layer and the second scoop portion. The tongue is connected to a top of the base. The limiting wall is connected to an end of the base and is higher than the base. The groove is formed between an outer end face of the tongue and the limiting wall. The outer end face of the tongue forms an inner stopper wall, and a face of the limiting wall facing the groove forms the outer stopper wall. The head portion includes a root end connecting to the groove, as well as the free end opposite to the root end. The tongues of the first scoop portions of two adjacent ones of the plurality of scoops are spaced from each other in a constant or increasing distance from the root ends to the free ends of the head portions. This arrangement permits fast removal of the mold, thus improving the convenience in forming the second leakproof layer and the yield rate of the second leakproof layer.

In the form shown, a portion of the base at the groove forms the waist portion of the first scoop portion, the remaining portion of the base and the tongue form the head portion of the first scoop portion, and the head portion of the first scoop portion includes a neck portion corresponding to the base. The neck portion has a width in a length direction of the tape, and the width of the neck portion is smaller than a width of a free end of the base in the length direction of the tape. This arrangement permits mutual engagement between the first scoop portions, improving the sealing strength of the watertight zipper.

In the form shown, the second scoop portion has a same structure as the first scoop portion. This arrangement provides each stringer tape with two second leakproof layers, enhancing the watertight effect.

In the form shown, the tongue includes two inclined guiding faces at a free end thereof, and the two inclined guiding faces are spaced from each other in the length direction of the tape. This arrangement increases the production efficiency and product yield rate.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
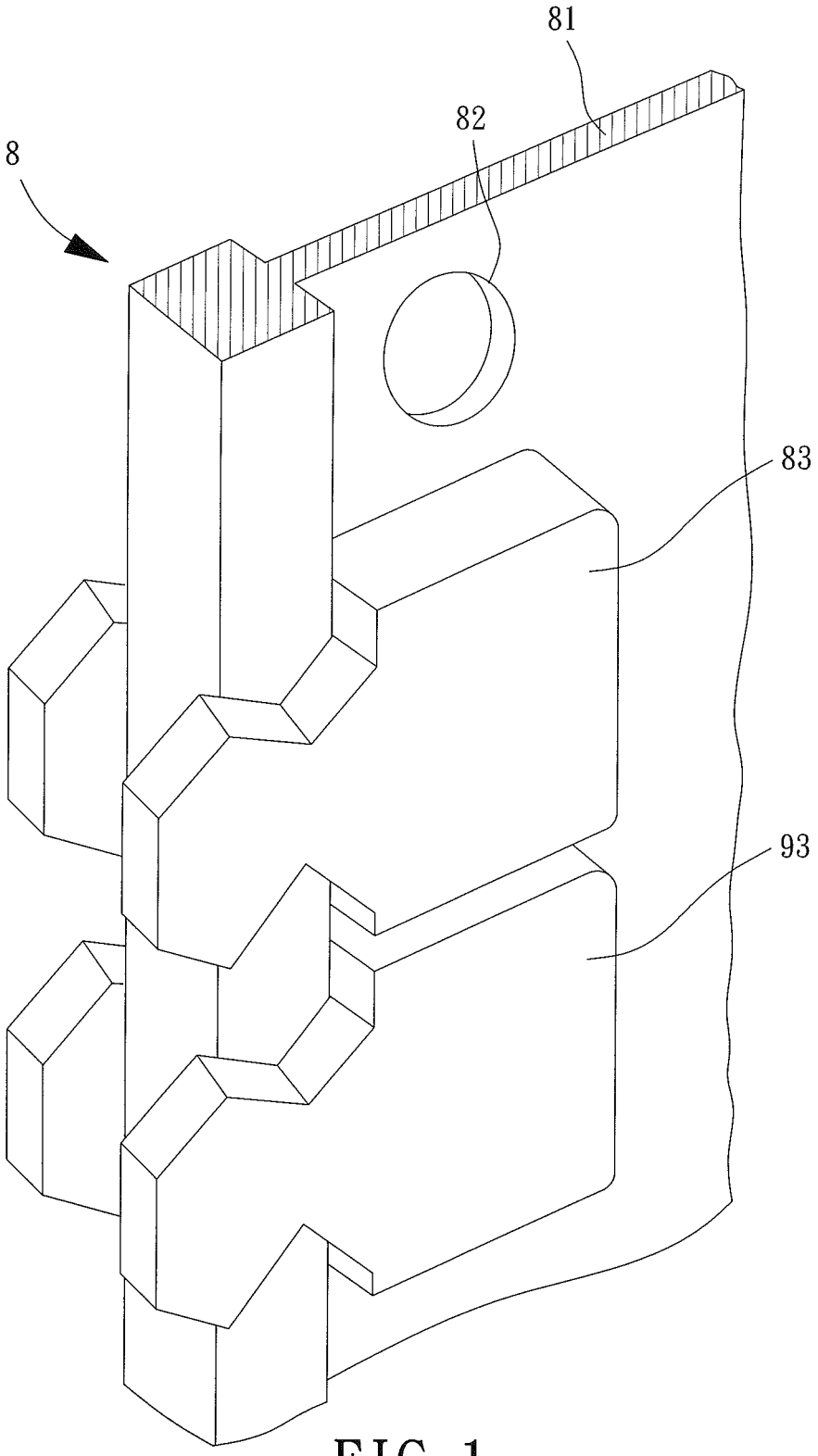
FIG. 1 PRIOR ART
FIG. 1 shows a conventional waterproof tape.
Figure 2:
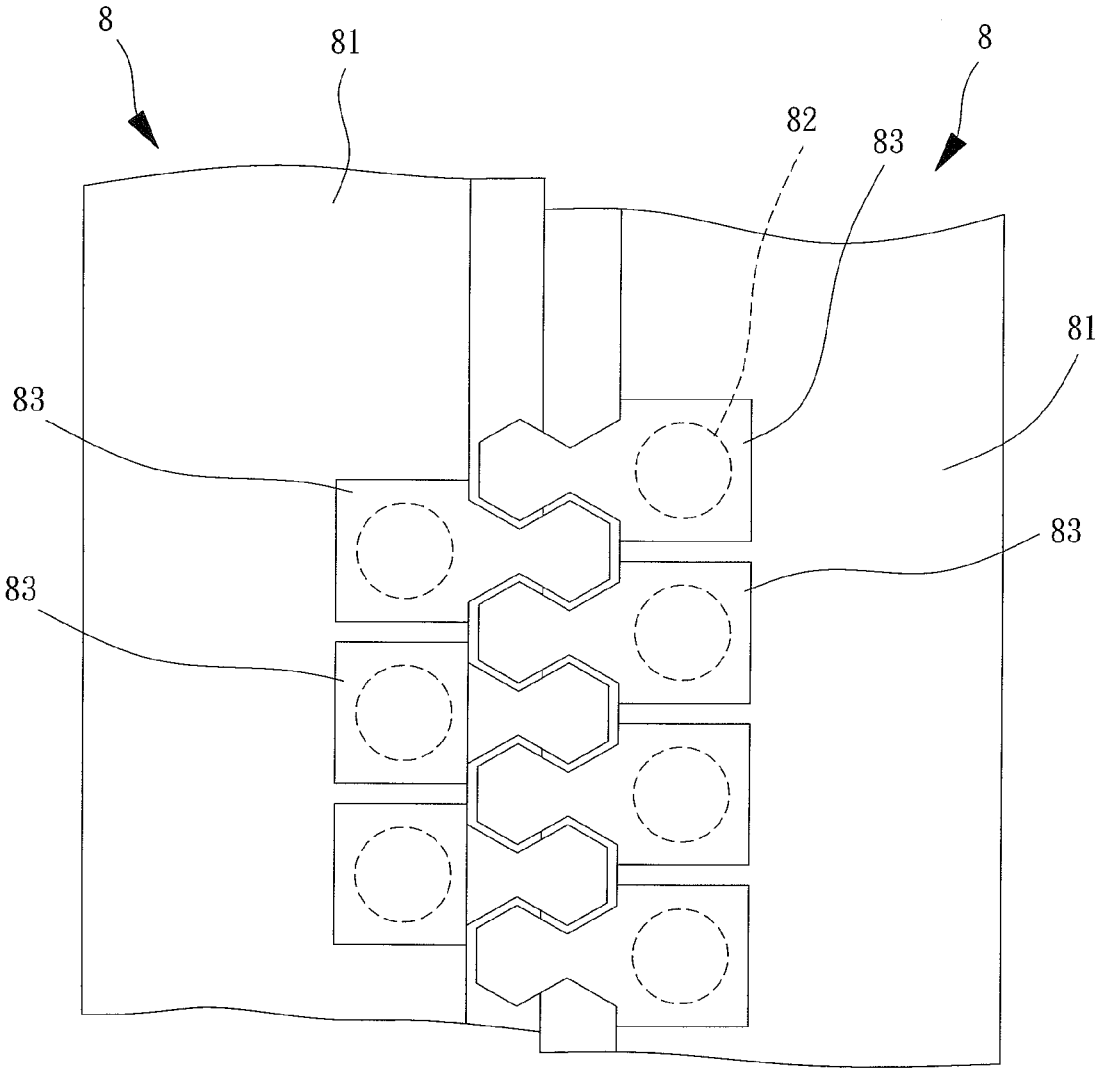
FIG. 2 PRIOR ART
FIG. 2 shows two of the conventional waterproof tapes that are bonded to each other.
Figure 3:
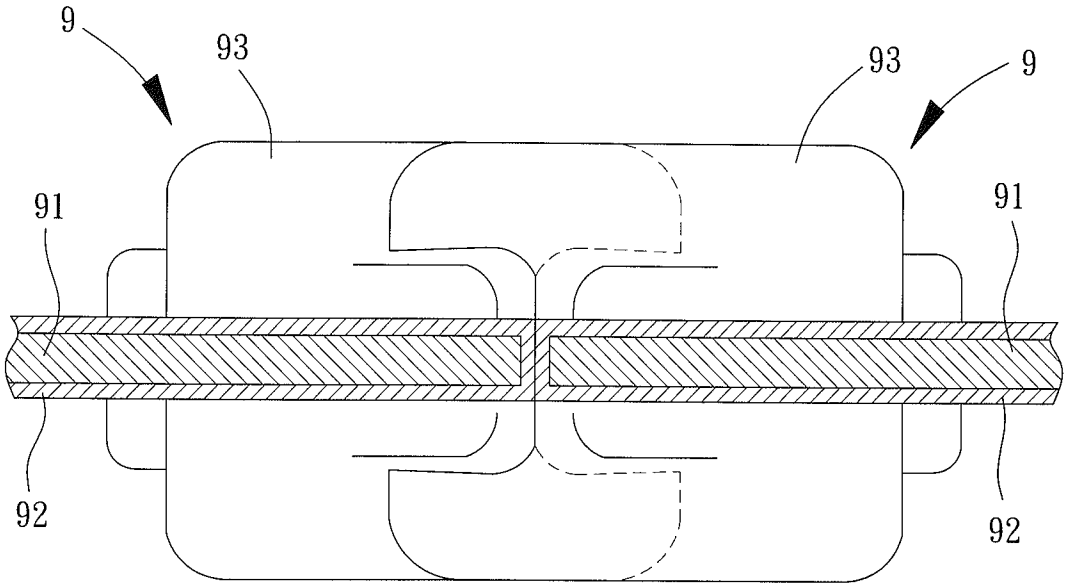
FIG. 3 PRIOR ART
FIG. 3 is a cross sectional view of another conventional waterproof tape.

In the various figures of the drawings, the same numerals designate the same or similar parts. Furthermore, when the terms "first", "second", "third", "fourth", "inner", "outer", "top", "bottom", "front", "rear" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

Figure 4:
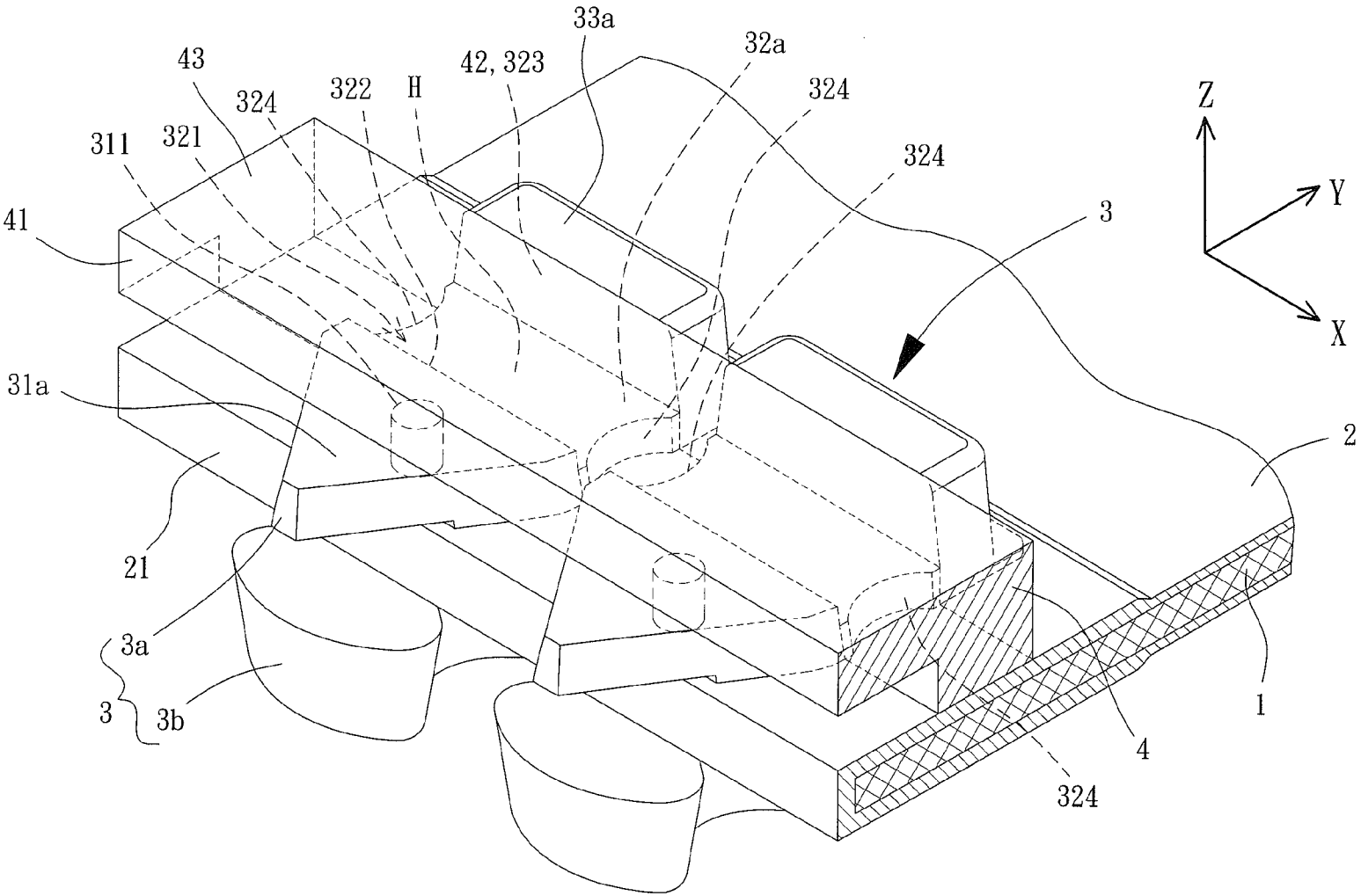
FIG. 4 is a perspective view of a stringer tape according to a first embodiment of the invention.

The invention provides a double-layered watertight zipper having two stringer tapes that can be engaged with each other. In this regard, FIG. 4 shows a stringer tape according to a first embodiment of the invention. The stringer tape includes a tape 1, a first leakproof layer 2, a plurality of scoops 3 and a second leakproof layer 4. The outer face of the tape 1 is covered by the first leakproof layer 2 to form a waterproof tape. The scoops 3 are arranged in intervals side by side adjacent to one lateral side of the waterproof tape. The second leakproof layer 4 is arranged on the scoops 3 and connected to the first leakproof layer 2. Although only two scoops 3 are shown in the drawing, there are actually several scoops 3 in the practical use. The use of two scoops 3 in the drawing is merely to provide a clear and simple way to illustrate the structure of the stringer tape. Therefore, the actual quantity and shape of the scoops 3 are not limited to the drawing.

Besides, the length of the tape 1 extends in a direction X, the width of the tape 1 extends in a direction Y, and the thickness of the tape 1 extends in a direction Z. The directions X, Y and Z are orthogonal to each other. The terms "top" and "bottom" are defined as two opposite locations along the direction Z. In addition, when two tapes 1 are considered, the two faces of the two tapes 1 that are adjacent to each other in the direction Y are defined as inner faces, whereas the two faces of the two tapes 1 that are distant to each other in the direction Y are defined as outer faces.

Figure 5:
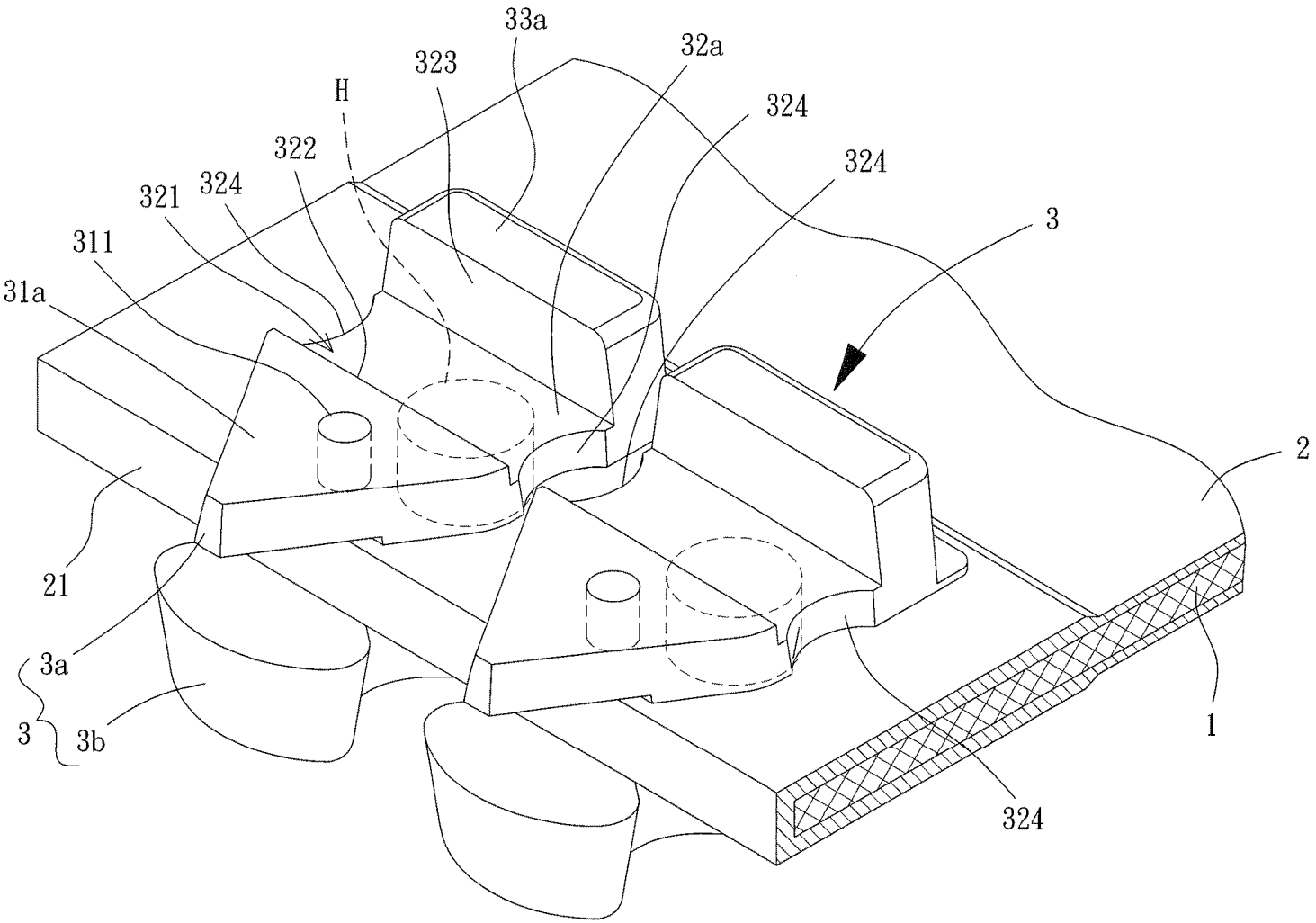
FIG. 5 is a perspective view of the stringer tape of the first embodiment of the invention without the second leakproof layer.

Referring to FIG. 5, the manufacturing method of the waterproof tape is not limited. For example, the waterproof tape can be produced by extruding the molten high polymeric material along the outer faces of the tape 1, including the top face, the bottom face and the inner face of the tape 1. After the high polymeric material cools down and solidifies, the inner face of the high polymeric material is trimmed by high precision laser cutting, thus forming the high polymeric material as the first leakproof layer 2. The trimmed inner face of the high polymeric material forms a first abutting face 21. Thus, the first abutting face 21, the first leakproof layer 2 and the tape 1 construct the waterproof tape. Alternatively, the first leakproof layer 2 can be formed by injection molding to ensure high evenness of the first abutting face 21. The inner face of the high polymeric material can also be trimmed by other precise cutting methods.

Figure 6:
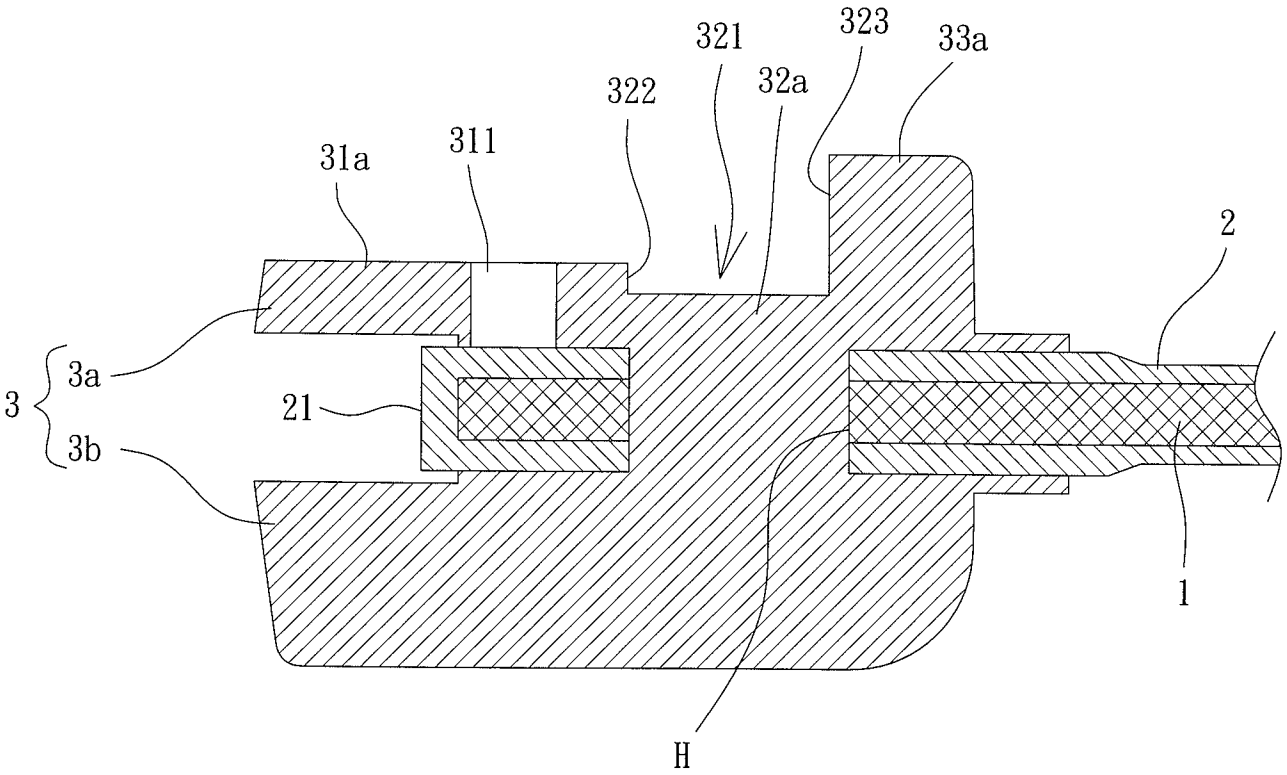
FIG. 6 is a cross sectional view of the stringer tape of the first embodiment of the invention without the second leakproof layer.

Referring to FIGS. 5 and 6, a plurality of through-holes H is arranged adjacent to the inner face of the waterproof tape. Each through-hole H extends through the tape 1 and the first leakproof layer 2, so that each scoop 3 can be formed through a corresponding through-hole H by injection molding. Each scoop 3 includes a first scoop portion 3*a* located on the top face of the waterproof tape, as well as a second scoop portion 3*b* located on the bottom face of the waterproof tape. The first scoop portion 3*a* and the second scoop portion 3*b* are connected to each other by the part of the scoop 3 inside the through-hole H.

Specifically, the first scoop portion 3*a* includes a head portion 31*a*, a waist portion 32*a* and a tail portion 33*a*. The head portion 31*a* includes a free end extending beyond the first abutting face 21 of the first leakproof layer 2. The head portion 31*a* can be in a triangular form in which the distance between two adjacent scoops 3 increases from the waist portions 32*a* to the free ends, thereby forming the second leakproof layer 4 (as will be described later). The head portion 31*a* may further include a positioning hole 311 which preferably extends through the head portion 31*a*, such that the first leakproof layer 2 at the bottom end of the positioning hole 311 is exposed from the positioning hole 311.

The waist portion 32*a* forms a groove 321 between the head portion 31*a* and the tail portion 33*a*. The groove 321 may extend through two ends of the waist portion 32*a* in the direction X, thus forming an inner stopper wall 322 at the side of the waist portion 32*a* adjacent to the head portion 31*a*. Also, the waist portion 32*a* forms an outer stopper wall 323 at the side adjacent to the tail portion 33*a*. The outer stopper wall 323 is higher than the inner stopper wall 322. Each end of the waist portion 32*a* in the direction X may include a concave portion 324.

Figure 7:
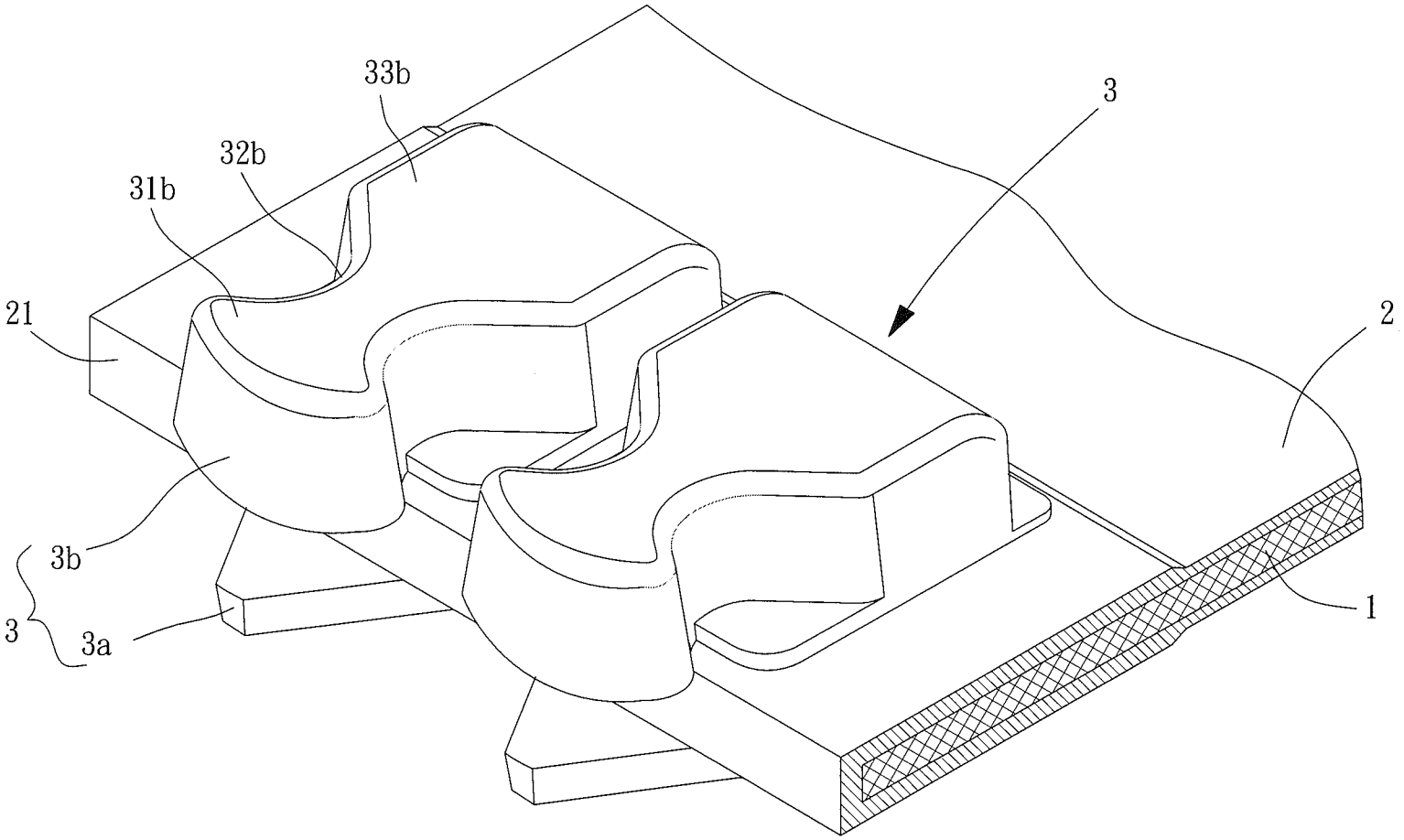
FIG. 7 is another angle of view of the stringer tape of the first embodiment of the invention without the second leakproof layer.

Referring to FIG. 7, the second scoop portion 3*b* may include a head portion 31*b*, a waist portion 32*b* and a tail portion 33*b* connected in series. The width of the waist portion 32*b* in the direction X is smaller than the width of head portion 31*b* and tail portion 33*b* in the direction X. In this arrangement, when two waterproof tapes (the first and second ones) are considered, the interlaced left and right scoops 3 can be engaged with each other in a manner that the head portion 31*b* of the second scoop portion 3*b* of one of the scoops 3 of the first waterproof tape (or the second waterproof tape) is engaged between the waist portions 32*b* of the second scoop portions 3*b* of two adjacent scoops 3 of the second waterproof tape (or the first waterproof tape).

Figure 8:
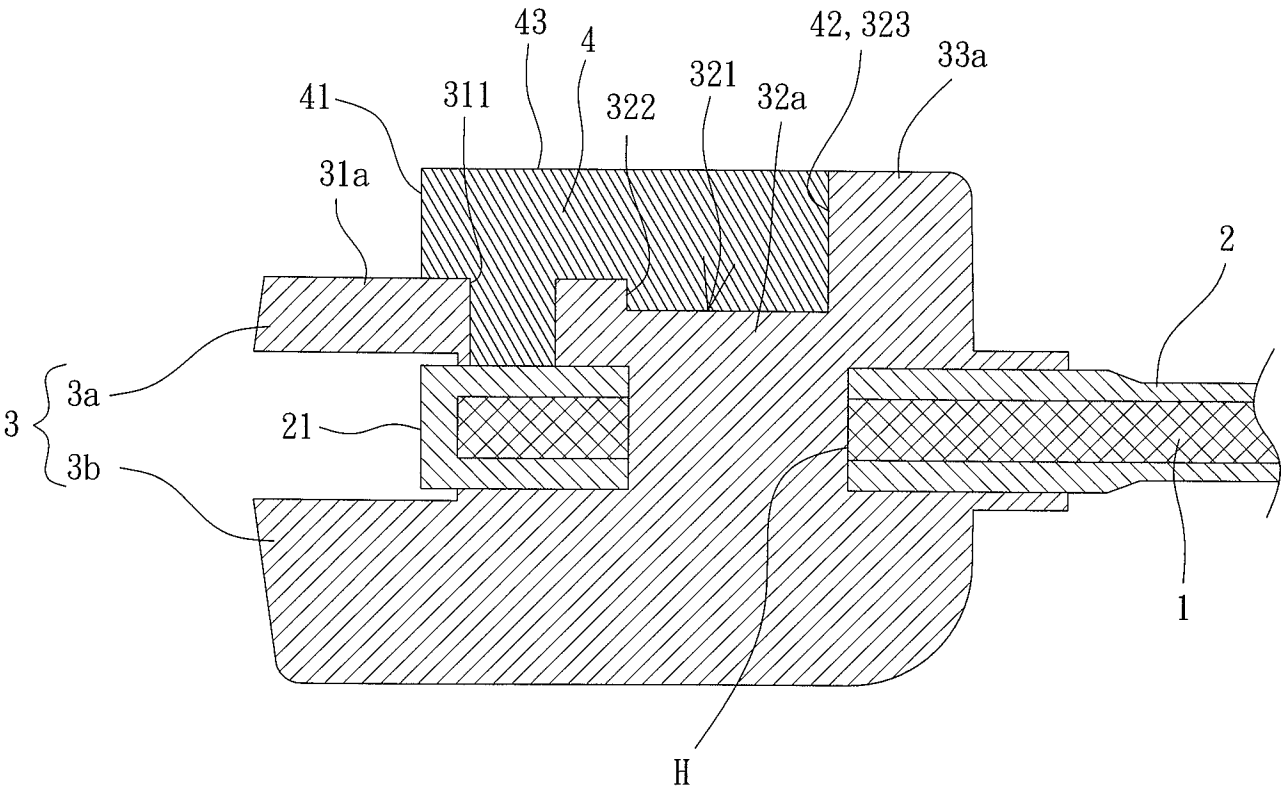
FIG. 8 is a cross sectional view of the stringer tape of the first embodiment of the invention.

Referring to FIGS. 4 and 8, after the scoops 3 are formed, the second leakproof layer 4 is subsequently formed. The second leakproof layer 4 includes a second abutting face 41, an outer end face 42 and a top face 43. The second abutting face 41 is opposite to the outer end face 42. The top face 43 is connected between the second abutting face 41 and the outer end face 42. The head portion 31*a* of the first scoop portion 3*a* is partially covered by the second leakproof layer 4. The second abutting face 41 of the second leakproof layer 4 preferably flushes with the first abutting face 21 of the first leakproof layer 2 in the direction Z. The groove 321 of the first scoop portion 3*a* is filled with the second leakproof layer 4. The outer end face 42 of the second leakproof layer 4 is connected to the outer stopper wall 323 of the first scoop portion 3*a*.

In addition, the space between the waist portions 32*a* of two adjacent scoops 3 is also filled with the second leakproof layer 4. The second leakproof layer 4 is connected to the first leakproof layer 2 through the space. The second leakproof layer 4 and the first leakproof layer 2 may be made of the same material. Alternatively, the second leakproof layer 4 may have a higher melting point than the first leakproof layer 2, so that the second leakproof layer 4 and the first leakproof layer 2 can fuse together when the second leakproof layer 4 is formed. As such, the bonding strength between the second leakproof layer 4 and the first leakproof layer 2 can be improved. Furthermore, the arrangement of the concave portion 324 can increase the contact area between the second leakproof layer 4 and the first leakproof layer 2, reinforcing the bonding strength between the second leakproof layer 4 and the first leakproof layer 2 while providing a stable positioning effect of the second leakproof layer 4. This can better prevent breaking of the second leakproof layer 4 when the second leakproof layer 4 experiences an external force applied in the direction Y.

It is noted that the formation of the second leakproof layer 4 is not limited to any particular manner. In the first embodiment of the invention, the second leakproof layer 4 is formed by injection molding, but this is not used to limit the invention. Specifically, in the first embodiment of the invention, the waterproof tape including a plurality of scoops 3 is placed in a mold. The mold includes a cavity receiving a slider. The slider covers the waterproof tape except for the area where the second leakproof layer 4 is going to be formed. Thus, the material can be injected into the cavity to fill the area, thereby forming the second leakproof layer 4. Since the head portion 31*a* of the scoop 3 is substantially in a triangular form, the triangular slider in the cavity can fit into the space between the head portions 31*a* of the first scoop portions 3*a* of two adjacent scoops 3 before injection of the material. Then, the mold can be smoothly removed after the injected material solidifies. In such a manner, the tape can be formed with the first leakproof layer 2 and the second leakproof layer 4. The formation of the second leakproof layer 4 is convenient, and the yield rate is increased.

Besides, when the head portion 31*a* of the first scoop portion 3*a* includes the positioning hole 311, the positioning hole 311 can also be filled by the injected material. Thus, the second leakproof layer 4 can have one extra positioning point at the head portion 31*a* of the first scoop portion 3*a*, reinforcing the coupling strength between the second leakproof layer 4 and the scoop 3. In particular, when the positioning hole 311 extends through the head portion 31*a*, the portion of the second leakproof layer 4 in the positioning hole 311 can also fuse with the first leakproof layer 2. As a result, it is even more difficult to separate the second leakproof layer 4 and the first leakproof layer 2 from each other, improving the bonding strength therebetween.

Figure 9:
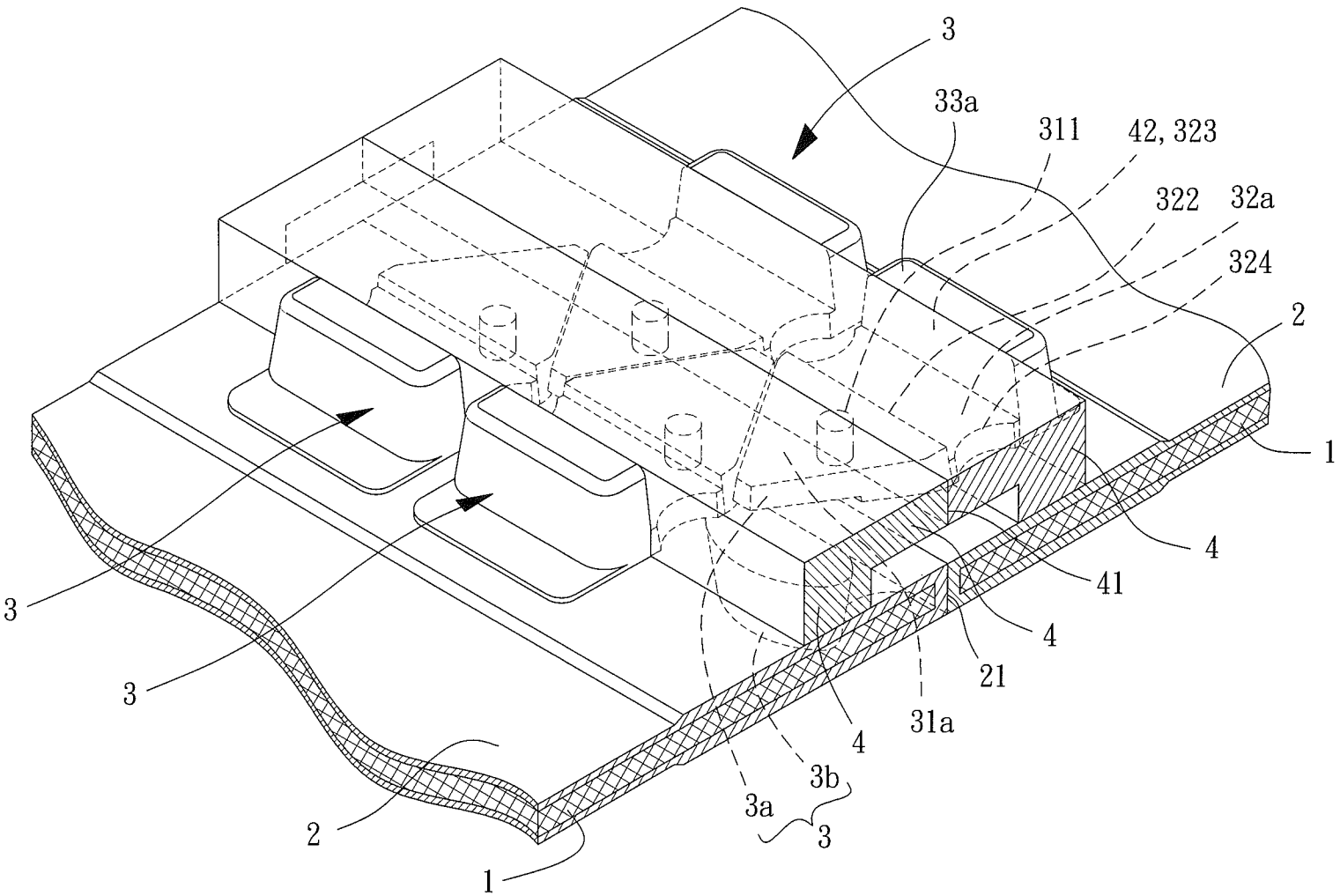
FIG. 9 is a perspective view of two of the stringer tapes of the first embodiment of the invention that are connected to each other.
Figure 10:
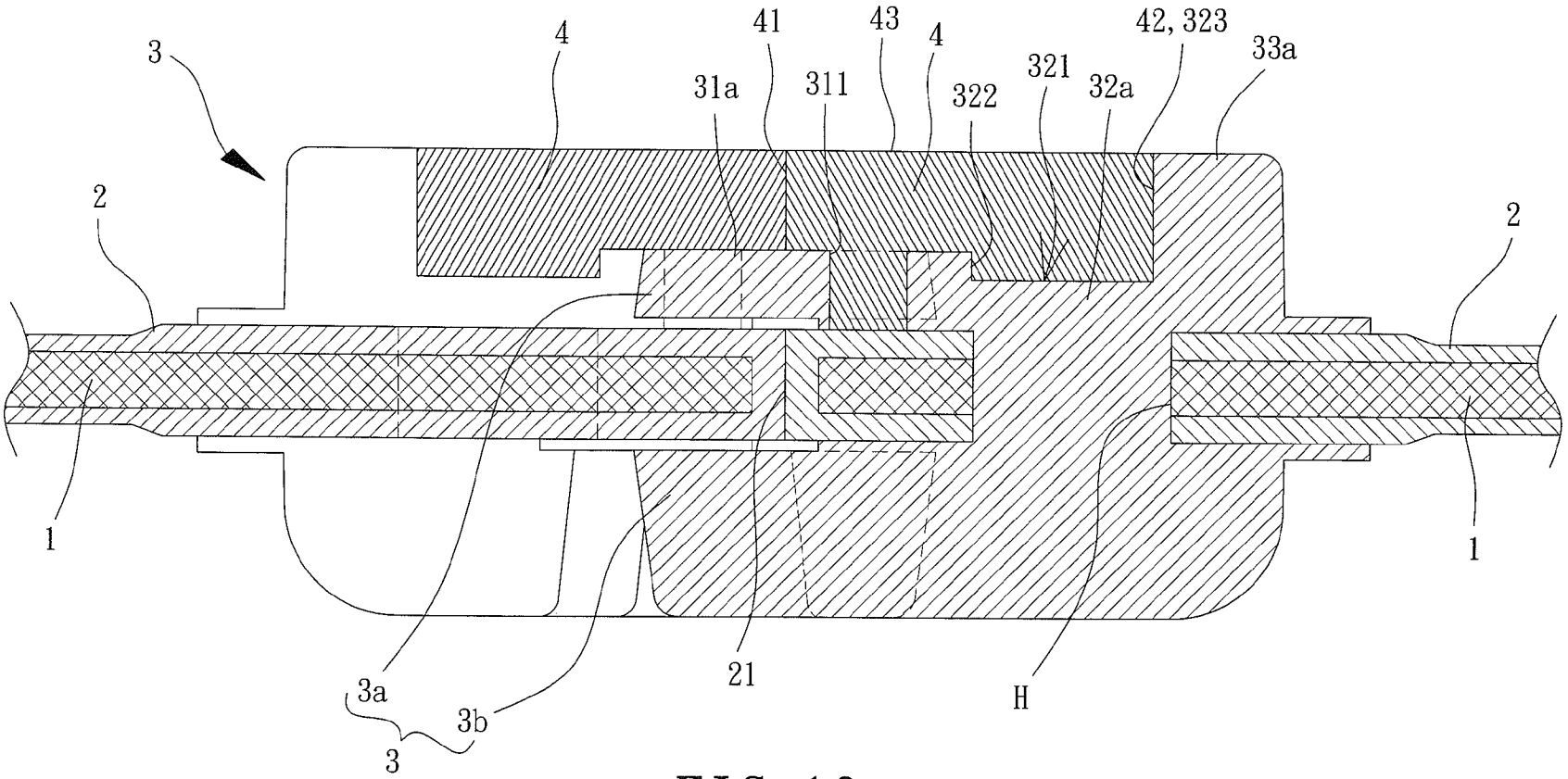
FIG. 10 is a cross sectional view of two of the stringer tapes of the first embodiment of the invention that are connected to each other.

Referring to FIGS. 9 and 10, based on the above structure, two opposing tapes (left and right ones) can be connected to each other to form the double-layered watertight zipper of the first embodiment of the invention. At this time, the left and right scoops 3 of the two tapes can be engaged with each other, so that the first abutting faces 21 of the first leakproof layers 2 of the two tapes can firmly abut with each other, and the second abutting faces 41 of the second leakproof layers 4 of the two tapes can firmly abut with each other.

When the double-layered watertight zipper of the first embodiment of the closure invention is used in a test to verify its resistance to fluid leakage, the result showed that even though the high pressure fluid can possibly pass between the first leakproof layers 2, the pressure of the fluid is largely reduced so that the pressure becomes too small to pass between the second leakproof layers 4. Thus, the double-layered watertight zipper of the first embodiment of the invention has a much higher resistance to the fluid leakage and an excellent leakproof effect over the conventional ones.

Figure 11:
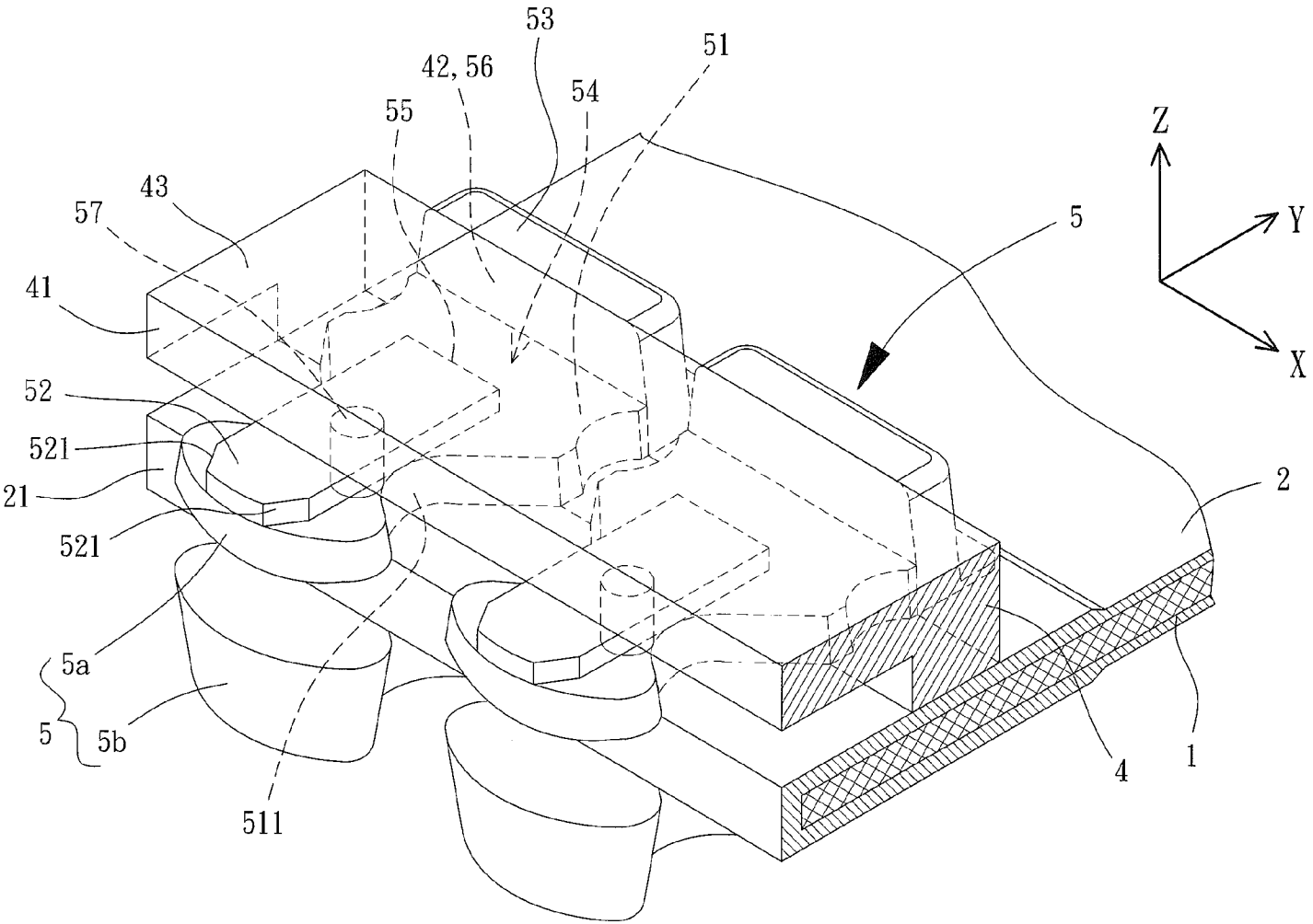
FIG. 11 is a perspective view of a stringer tape according to a second embodiment of the invention.
Figure 12:
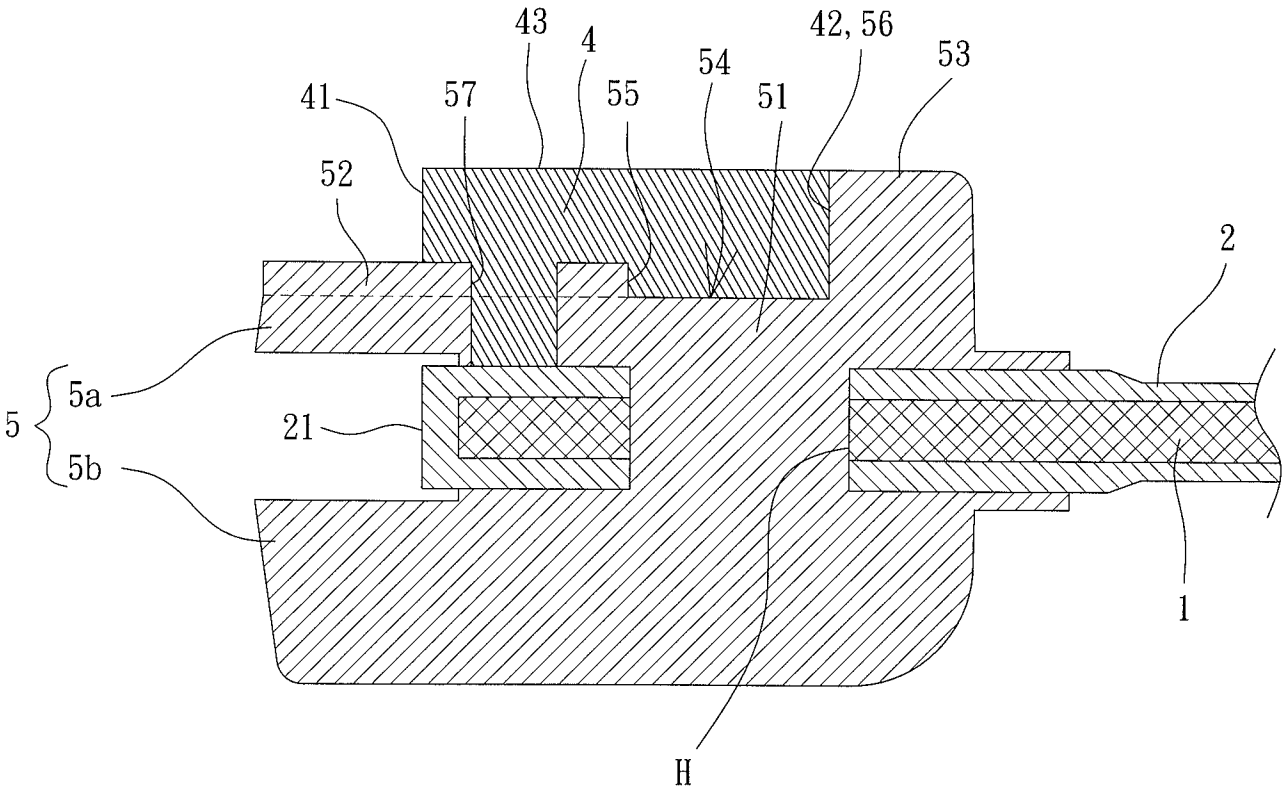
FIG. 12 is a cross sectional view of the stringer tape of the second embodiment of the invention.

FIGS. 11 and 12 show a double-layered watertight zipper according to a second embodiment of the invention. The second embodiment in most part is the same as the first embodiment, but differs from the first embodiment in that both the first scoop portion 5*a* and the second scoop portion 5*b* of the scoop 5 can provide an engaging function.

Specifically, the scoop 5 includes a base 51, a tongue 52 and a limiting wall 53. The base 51 is connected to the first leakproof layer 2 and the second scoop portion 5*b*. The tongue 52 is connected to the top of the base 51. The limiting wall 53 is connected to an end of the base 51 and is higher than the base 51, so that a groove 54 is formed between the outer end face of the tongue 52 and the limiting wall 53. Thus, the portion of the base 51 at the groove 54 forms a waist portion of the first scoop portion 5*a*, the remaining portion of the base 51 and the tongue 52 form a head portion of the first scoop portion 5*a*, and the limiting wall 53 forms a tail portion of the first scoop portion 5*a*. Moreover, the outer end face of the tongue 52 forms an inner stopper wall 55, and the face of the limiting wall 53 facing the groove 54 forms an outer stopper wall 56.

In particular, the head portion of each first scoop portion 5*a* includes a neck portion 511 corresponding to the base 51. The width of the neck portion 511 in the direction X is smaller than the width of the free end of the base 51 in the direction X. The tongue 52 includes a root end connecting to the groove 54 and a free end opposite to the root end. The tongues 52 of two adjacent first scoop portions 5*a* are spaced from each other in a constant distance from the root ends to the free ends of the tongues 52. Alternatively, the tongues 52 of two adjacent first scoop portions 5*a* may be spaced from each other in an increasing distance from the ends of the tongues 52 (i.e. root ends), which forms the grooves 54, to the free ends of the tongues 52. Therefore, when it is desired to form the second leakproof layer 4, the slider in the mold can fit into the spacing between the tongues 52 of two adjacent first scoop portions 5*a* before the material is injected. Then, the material is injected, and it takes a while for the injected material to cool down and solidify. After the injected material solidifies, the mold is removed, thus forming the waterproof tape with the first leakproof layer 2 and the second leakproof layer 4. This improves the convenience in forming the second leakproof layer 4 and the yield rate of the second leakproof layer 4. The tongue 52 includes two inclined guiding faces 521 at its free end. The two inclined guiding faces 521 are spaced from each other in the direction X. The inclined guiding face 521 can guide the mold into the spacing between the tongues 52 when it is about to inject the material, improving the manufacturing efficiency and yield rate of the product. Each first scoop portion 5*a* may further include a positioning hole 57 extending through the tongue 52 and the base 51, such that the first leakproof layer 2 at the bottom end of the positioning hole 57 is exposed from the positioning hole 57. As such, the bonding strength between the second leakproof layer 4 and the first leakproof layer 2 can be reinforced. The details regarding the second scoop portion 5*b* of each scoop 5 are similar to those described in the first embodiment, and therefore are not described herein again.

Figure 13:
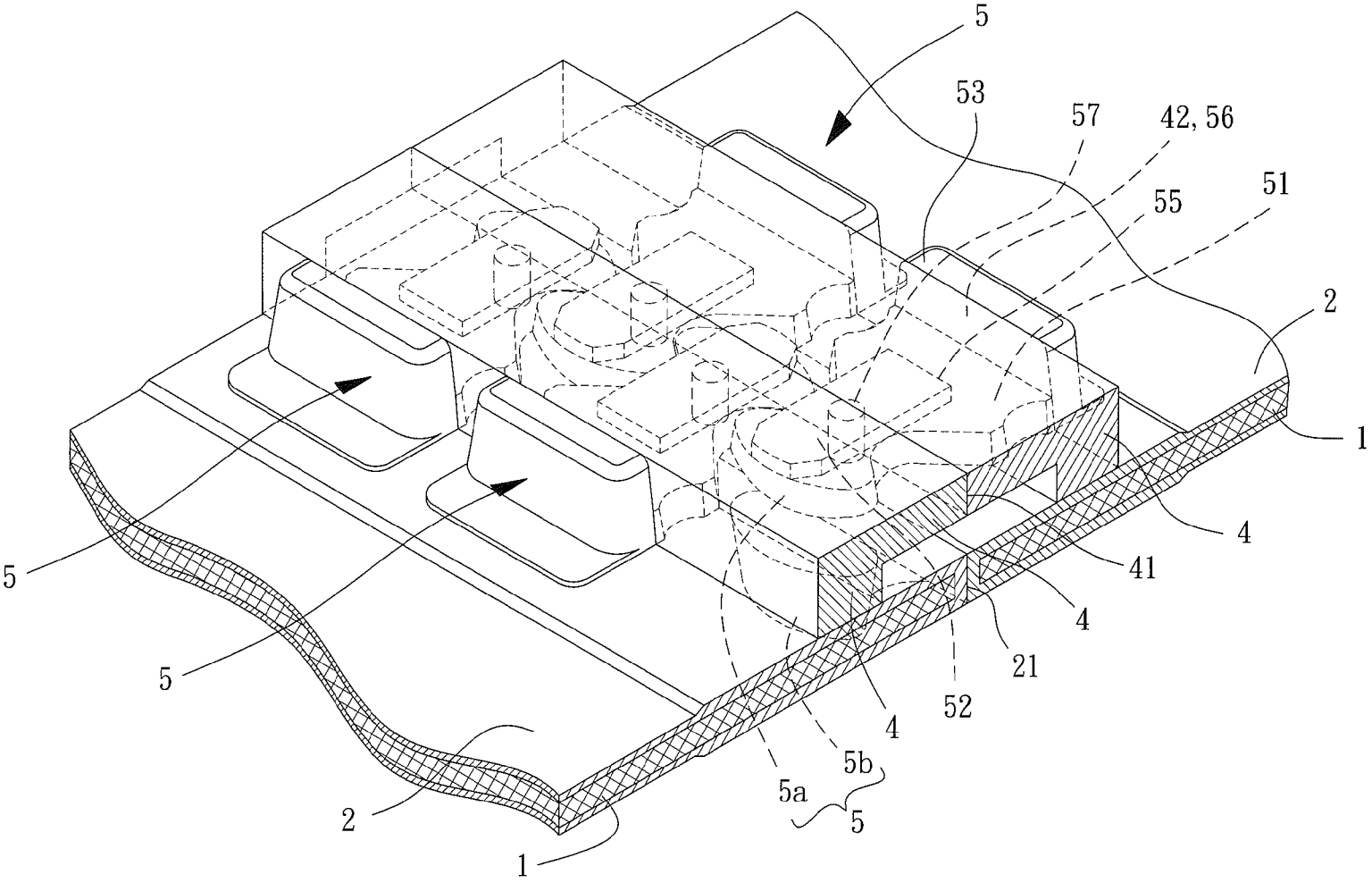
FIG. 13 is a perspective view of two of the stringer tapes of the second embodiment of the invention that are connected to each other.

Referring to FIGS. 12 and 13, when two of the above waterproof tapes are combined with each other to form the double-layered watertight zipper of the second embodiment of the invention, the first abutting faces 21 of the first leakproof layers 2 of the two waterproof tapes can also firmly abut against each other, and the second abutting faces 41 of the second leakproof layers 4 of the two waterproof tapes can firmly abut against each other. Thus, the watertight zipper of the second embodiment can attain the same watertight effect as that of the first embodiment. Besides, in the second embodiment, the first scoop portions 5*a* of the left and right scoops 5 can be engaged with each other via the neck portions 511. Thus, in the second embodiment, both the first scoop portion 5*a* and the second scoop portion 5*b* can provide an engaging effect for the watertight zipper. As an advantage, the left and right scoops 5 are less likely to disengage from each other. Accordingly, the double-layered watertight zipper in the second embodiment of the invention can provide an enhanced engaging effect while maintaining the convenience in forming the second leakproof layer 4.

Figure 14:
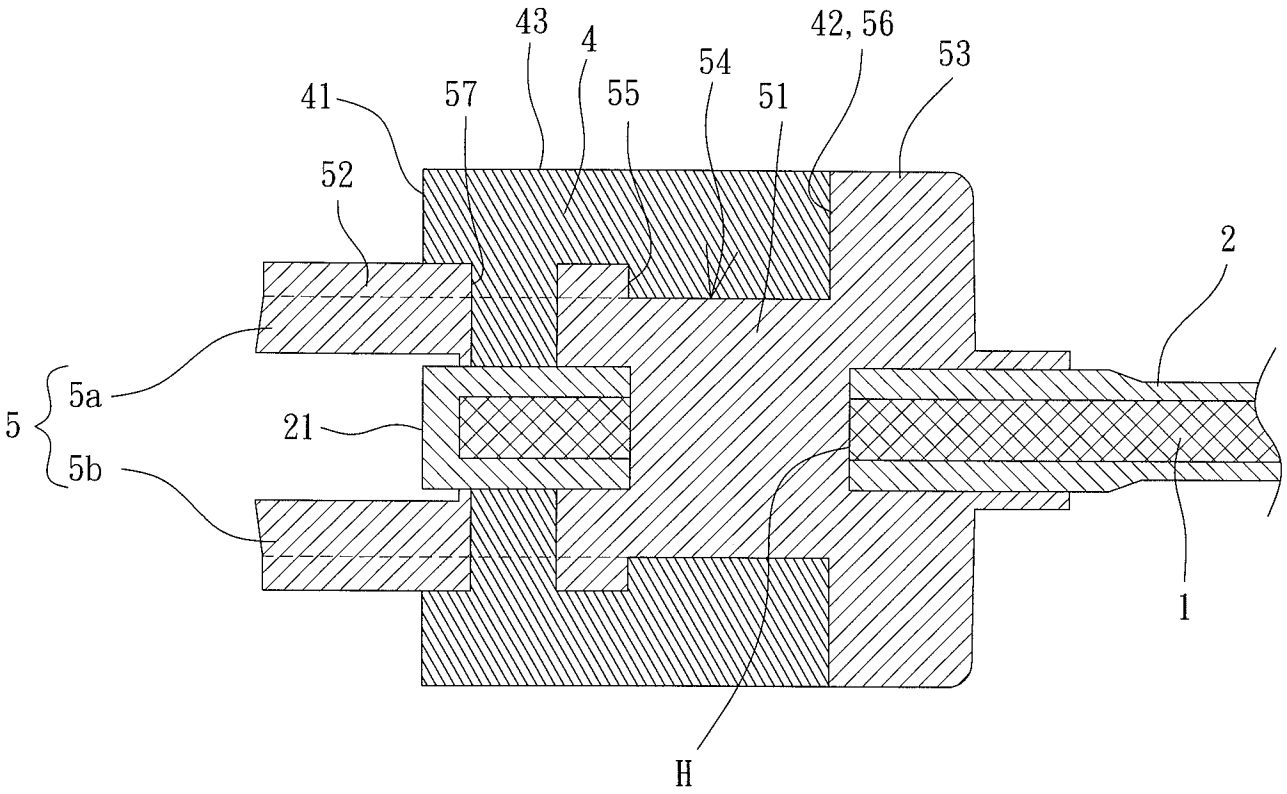
FIG. 14 is a cross sectional view of a stringer tape according to a further embodiment of the invention.

Referring to FIG. 14, in a third embodiment, the second scoop portion 5*b* may have the same shape as the first scoop portion 5*a*. In this arrangement, each waterproof tape can have two second leakproof layers 4, further improving the watertight effect of the double-layered watertight zipper.

In summary, although a small amount of high pressure liquid may possibly pass between the first leakproof layers 2 of the double-layered watertight zipper of the invention, the high pressure liquid will be stopped by the second leakproof layers 4 due to the reduced pressure. Thus, the watertight zipper of the invention has an excellent watertight effect along with high utility.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A double-layered watertight zipper comprising first and second stringer tapes that can be engaged with each other, wherein each of the first and second stringer tapes comprises:

a tape;

a first leakproof layer arranged on an outer face of the tape, wherein the first leakproof layer and the tape construct a waterproof tape, wherein the first leakproof layer comprises an inner face forming a first abutting face;

a plurality of scoops arranged on the waterproof tape in intervals side by side adjacent to an inner lateral side of the waterproof tape, wherein each of the plurality of scoops comprises a first scoop portion and a second scoop portion, wherein the first scoop portion comprises a head portion, a waist portion and a tail portion connected in sequence, wherein the head portion comprises a free end extending beyond the first abutting face of the first leakproof layer, wherein the waist portion forms a groove, wherein an inner stopper wall is formed at a side of the waist portion adjacent to the head portion, and an outer stopper wall is formed at another side of the waist portion adjacent to the tail portion, and wherein the outer stopper wall is higher than the inner stopper wall; and a second leakproof layer arranged on the plurality of scoops and connected to the first leakproof layer, wherein the second leakproof layer comprises an inner face forming a second abutting face, wherein the second leakproof layer comprises an outer end face opposite to the second abutting face, wherein the waist portions of the first scoop portions of the plurality of scoops form a plurality of spaces therebetween, wherein the plurality of spaces and the grooves of the first scoop portions of the plurality of scoops are filled with the second leakproof layer, and wherein the outer end face of the second leakproof layer is connected to the outer stopper walls of the first scoop portions of the plurality of scoops;

wherein when the plurality of scoops of the first stringer tape is engaged with the plurality of scoops of the second stringer tape, the first abutting face of the first stringer tape is in abutment with the first abutting face of the second stringer tape, and wherein the second abutting face of the first stringer tape is in abutment with the second abutting face of the second stringer tape.

2. The double-layered watertight zipper as claimed in claim 1, wherein the second abutting face of the second leakproof layer is flush with the first abutting face of the first leakproof layer in a thickness direction of the tape.

3. The double-layered watertight zipper as claimed in claim 1, wherein each of two ends of the waist portion forms a concave portion.

4. The double-layered watertight zipper as claimed in claim 1, wherein the head portion of the first scoop portion comprises a positioning hole.

5. The double-layered watertight zipper as claimed in claim 4, wherein the positioning hole extends through the head portion, wherein the first leakproof layer at a bottom end of the positioning hole is exposed from the positioning hole.

6. The double-layered watertight zipper as claimed in claim 1, wherein the second leakproof layer is formed by injection molding.

7. The double-layered watertight zipper as claimed in claim 2, wherein the second leakproof layer is formed by injection molding.

8. The double-layered watertight zipper as claimed in claim 3, wherein the second leakproof layer is formed by injection molding.

9. The double-layered watertight zipper as claimed in claim 4, wherein the second leakproof layer is formed by injection molding.

10. The double-layered watertight zipper as claimed in claim 5, wherein the second leakproof layer is formed by injection molding.

11. The double-layered watertight zipper as claimed in claim 6, wherein the first and second leakproof layers are made of a same material or the second leakproof layer has a higher melting point than the first leakproof layer.

12. The double-layered watertight zipper as claimed in claim 6, wherein the head portion comprises a root end connecting to the waist portion, as well as the free end opposite to the root end, wherein the head portions of the first scoop portions of two adjacent ones of the plurality of scoops are spaced from each other in an increasing distance from the root ends to the free ends thereof.

13. The double-layered watertight zipper as claimed in claim 6, wherein the first scoop portion comprises a base, a tongue and a limiting wall, wherein the base is connected to the first leakproof layer and the second scoop portion, wherein the tongue is connected to a top of the base, wherein the limiting wall is connected to an end of the base and is higher than the base, wherein the groove is formed between an outer end face of the tongue and the limiting wall, wherein the outer end face of the tongue forms an inner stopper wall, and a face of the limiting wall facing the groove forms the outer stopper wall, wherein the head portion comprises a root end connecting to the groove, as well as the free end opposite to the root end, and wherein the tongues of the first scoop portions of two adjacent ones of the plurality of scoops are spaced from each other in a constant distance from the root ends to the free ends of the head portions.

14. The double-layered watertight zipper as claimed in claim 6, wherein the first scoop portion comprises a base, a tongue and a limiting wall, wherein the base is connected to the first leakproof layer and the second scoop portion, wherein the tongue is connected to a top of the base, wherein the limiting wall is connected to an end of the base and is higher than the base, wherein the groove is formed between an outer end face of the tongue and the limiting wall, wherein the outer end face of the tongue forms an inner stopper wall, and a face of the limiting wall facing the groove forms the outer stopper wall, wherein the head portion comprises a root end connecting to the groove, as well as the free end opposite to the root end, and wherein the tongues of the first scoop portions of two adjacent ones of the plurality of scoops are spaced from each other in an increasing distance from the root ends to the free ends of the head portions.

15. The double-layered watertight zipper as claimed in claim 13, wherein a portion of the base at the groove forms the waist portion of the first scoop portion, wherein a remaining portion of the base and the tongue form the head portion of the first scoop portion, wherein the head portion of the first scoop portion comprises a neck portion corresponding to the base, wherein the neck portion has a width in a length direction of the tape, and wherein the width of the neck portion is smaller than a width of a free end of the base in the length direction of the tape.

16. The double-layered watertight zipper as claimed in claim 15, wherein the second scoop portion has a same structure as the first scoop portion.

17. The double-layered watertight zipper as claimed in claim 13, wherein the tongue comprises two inclined guiding faces at a free end thereof, and wherein the two inclined guiding faces are spaced from each other in a length direction of the tape.

* * * * *